US008808054B1

(12) United States Patent
Barthold

(10) Patent No.: US 8,808,054 B1
(45) Date of Patent: Aug. 19, 2014

(54) METHOD AND APPARATUS FOR LAUNCHING ACTION FIGURES

(75) Inventor: Mark J. Barthold, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 566 days.

(21) Appl. No.: 13/016,442

(22) Filed: Jan. 28, 2011

Related U.S. Application Data

(60) Provisional application No. 61/299,212, filed on Jan. 28, 2010.

(51) Int. Cl.
*A63J 19/00* (2006.01)

(52) U.S. Cl.
USPC ..... 446/365; 446/312; 446/359; 446/376; 446/309; 446/330; 446/83; 446/390; 446/486

(58) Field of Classification Search
USPC ..... 446/308–312, 330, 333–336, 359–360, 446/365, 97–101, 117–121, 82–83, 75, 379, 446/376, 381, 390, 486, 317; 273/108, 273/129 R, 440.1
See application file for complete search history.

(56) References Cited

U.S. PATENT DOCUMENTS 1,447,976 A * 3/1923 Gilchrist ..... 446/335
1,625,430 A * 4/1927 Robinson ..... 446/309
1,631,918 A * 6/1927 Correa, Jr. ..... 446/334
1,731,396 A * 10/1929 Root ..... 446/201
1,731,655 A * 10/1929 Fey ..... 446/334
1,736,163 A * 11/1929 McGee ..... 446/334
1,771,243 A * 7/1930 Berger ..... 446/335
1,781,307 A * 11/1930 Veronda ..... 446/335
1,799,735 A * 4/1931 Crowell ..... 446/334
1,811,929 A * 6/1931 Harris ..... 446/334
1,812,930 A * 7/1931 Chester ..... 446/335
1,834,165 A * 12/1931 Lindgard ..... 446/334
1,907,285 A * 5/1933 Block ..... 446/335
2,002,026 A * 5/1935 Fairgrieve ..... 273/440.1
2,088,510 A * 7/1937 Frasca ..... 446/334
2,158,052 A * 5/1939 Berger ..... 446/303
2,269,095 A * 1/1942 Davis ..... 446/334
2,435,141 A * 1/1948 Koci ..... 273/440.1
2,454,095 A * 11/1948 Sandlovich ..... 248/346.03
2,496,725 A * 2/1950 Hotcaveg ..... 446/335
2,499,147 A * 2/1950 Land ..... 446/334
2,538,744 A * 1/1951 Berry ..... 446/335
2,569,260 A * 9/1951 Schechtel ..... 446/334
2,586,432 A * 2/1952 Land ..... 446/334
2,598,954 A * 6/1952 Wengel ..... 310/39
2,603,034 A * 7/1952 Whitloek ..... 446/334
2,621,010 A * 12/1952 White ..... 248/499
2,622,835 A * 12/1952 Ippolito ..... 248/346.06
2,716,840 A * 9/1955 Armstrong ..... 446/334

(Continued)

*Primary Examiner* — Gene Kim
*Assistant Examiner* — Matthew B Stanczak
(74) *Attorney, Agent, or Firm* — Cantor Colburn LLP

(57) ABSTRACT

In one embodiment, an action piece for a toy play set is provided, the action piece being configured to have at least three separate engagement features configured to retain and subsequently release a portion of an action figure. In another embodiment a play set is provided, the play set having: a ring structure, at least one action figure and an action piece for securement to a portion of the ring structure. In still another embodiment, a method of launching an action figure from a play set in order to cause the action figure to fly through the air in a predetermined fashion is provided.

16 Claims, 13 Drawing Sheets

(56) References Cited

U.S. PATENT DOCUMENTS

| | | | | | |
|---|---|---|---|---|---|
| 2,760,306 | A | * | 8/1956 | Pelletier | 446/334 |
| 2,832,174 | A | * | 4/1958 | Yip | 446/75 |
| 2,867,362 | A | * | 1/1959 | Bloch | 223/120 |
| 3,106,800 | A | * | 10/1963 | Fletcher | 446/139 |
| 3,234,689 | A | * | 2/1966 | Ryan | 446/380 |
| 3,235,259 | A | * | 2/1966 | Glass et al. | 273/440.1 |
| 3,445,114 | A | * | 5/1969 | Fernandez | 273/348.3 |
| 3,699,712 | A | * | 10/1972 | Handler et al. | 446/325 |
| 3,790,165 | A | * | 2/1974 | Schmidt et al. | 273/452 |
| 3,845,956 | A | * | 11/1974 | Goldfarb et al. | 273/440.1 |
| 3,856,304 | A | * | 12/1974 | Matsumoto et al. | 273/440.1 |
| 3,927,883 | A | * | 12/1975 | Bosley et al. | 273/440.1 |
| 3,969,841 | A | * | 7/1976 | Joseph | 446/335 |
| 4,031,657 | A | * | 6/1977 | Crosman et al. | 446/333 |
| 4,091,563 | A | * | 5/1978 | Noble et al. | 273/440.1 |
| 4,165,579 | A | * | 8/1979 | Chase | 446/73 |
| 4,203,248 | A | * | 5/1980 | Tapdrup | 446/97 |
| 4,205,482 | A | * | 6/1980 | Christiansen et al. | 446/97 |
| 4,367,875 | A | * | 1/1983 | Barlow et al. | 273/440.1 |
| 4,435,915 | A | * | 3/1984 | Zaruba et al. | 446/75 |
| 4,609,195 | A | * | 9/1986 | Ham | 273/440.1 |
| 4,824,417 | A | * | 4/1989 | Jackson | 446/335 |
| 4,844,461 | A | * | 7/1989 | Namanny et al. | 273/440.1 |
| 4,985,008 | A | * | 1/1991 | Price | 446/308 |
| 4,988,323 | A | * | 1/1991 | Price | 446/334 |
| 4,995,610 | A | * | 2/1991 | Paoletti | 463/8 |
| 4,998,724 | A | * | 3/1991 | Hartman | 273/452 |
| 5,009,424 | A | * | 4/1991 | Harth et al. | 273/440.1 |
| 5,042,807 | A | * | 8/1991 | Sasakawa et al. | 273/440.1 |
| D325,479 | S | * | 4/1992 | Barfield | D21/355 |
| 5,209,694 | A | * | 5/1993 | Utt, Jr. | 446/73 |
| 5,458,523 | A | * | 10/1995 | Aoki et al. | 446/246 |
| 5,601,471 | A | * | 2/1997 | Kennedy | 446/236 |
| 5,690,330 | A | * | 11/1997 | Ozawa | 273/108.56 |
| 5,732,953 | A | * | 3/1998 | Tamura | 273/440.1 |
| 5,800,243 | A | * | 9/1998 | Berman | 446/420 |
| 5,989,094 | A | * | 11/1999 | Tamura | 446/335 |
| 6,179,685 | B1 | * | 1/2001 | Toft | 446/390 |
| 6,325,692 | B1 | * | 12/2001 | Webb | 446/75 |
| 6,368,178 | B1 | * | 4/2002 | Berman | 446/420 |
| 6,860,787 | B1 | * | 3/2005 | Woodhouse | 446/268 |
| 7,475,881 | B2 | * | 1/2009 | Blagg et al. | 273/440.1 |
| 2004/0248499 | A1 | * | 12/2004 | Costa | 446/376 |
| 2007/0128973 | A1 | * | 6/2007 | Blagg et al. | 446/334 |

* cited by examiner

METHOD AND APPARATUS FOR LAUNCHING ACTION FIGURES

CROSS REFERENCE TO RELATED APPLICATIONS

The present application claims the benefit to U.S. Provisional Patent Application Ser. No. 61/299,212 filed Jan. 28, 2010, the contents of which are incorporated herein by reference thereto.

BACKGROUND

Various embodiments of the present invention are related to an apparatus and method for launching action figures.

Children's toys have included miniature cars, boats, trains, figures, etc. wherein the user's imagination provides for hours of extended play and enjoyment. Toy figures that resemble fighting or combat type activities are particularly popular as the user can participate in imaginary battles and/or scenes.

Accordingly, it is desirable to provide a toy that resembles combat activities and allows for interaction with the user.

SUMMARY OF THE INVENTION

In one embodiment, an action piece for a toy play set is provided, the action piece being configured to have at least three separate engagement features configured to retain and subsequently release a portion of an action figure.

In another embodiment a play set is provided, the play set having: a ring structure, having a platform and a perimeter elevated from the platform; and at least one action figure, having a portion spring biased into a first position; and an action piece for securement to a portion of the perimeter such that the action piece is located above the platform, the action piece being configured to have at least one engagement feature configured to retain and subsequently release the portion of the action figure.

In still another embodiment, a method of launching an action figure from a play set in order to cause the action figure to fly through the air in a predetermined fashion is provided, the method including the steps of: inserting a spring biased portion of the action figure into an action piece configured to have at least three separate engagement features configured to retain and subsequently release the spring biased portion of the action figure, the spring biased portion being pivotally secured to another portion of the action figure; bending the another portion of the action figure after the spring biased portion is inserted into one of the at least three separate engagement features such that a spring biased force is generated; and releasing the another portion of the action figure, wherein the spring biased force causes the action figure to be launched from the action piece in a rotational manner.

BRIEF DESCRIPTION OF THE DRAWINGS

FIG. 3A is a top perspective view of the action piece illustrated in

FIG. 1;

DETAILED DESCRIPTION

Figure 1:
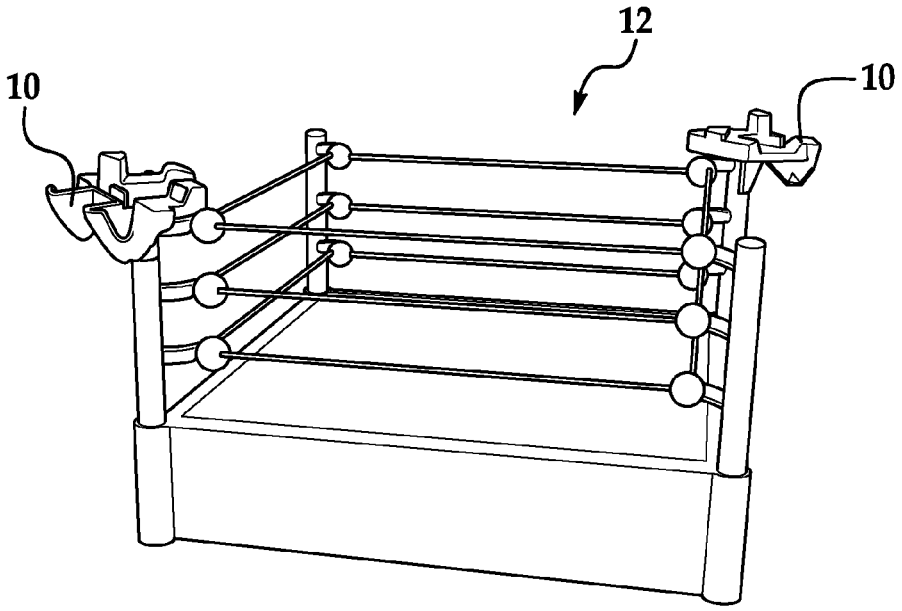
FIG. 1 is a perspective view of a play set and action piece constructed in accordance with an exemplary embodiment of the present invention.
Figure 2:
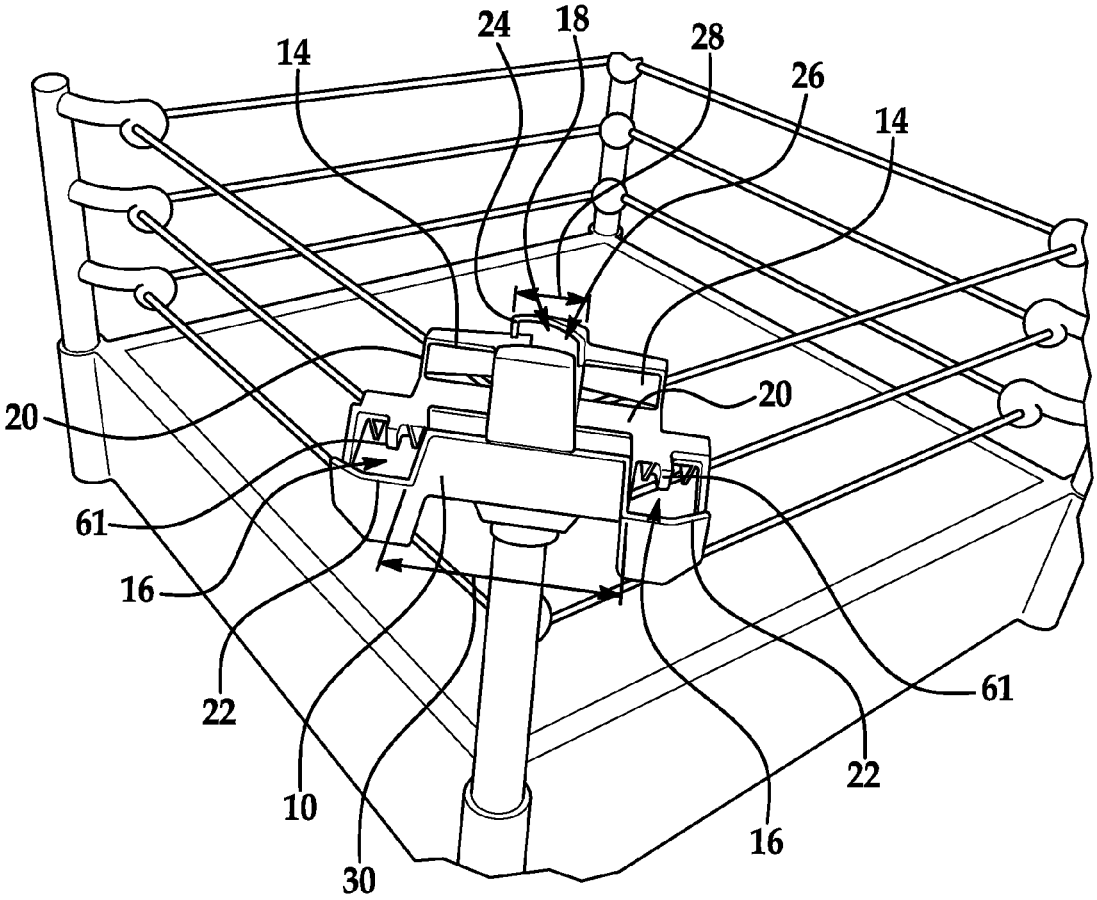
FIG. 2 is another perspective view of a play set and action piece of an embodiment of the invention.

In accordance with various embodiments of the present invention an apparatus and method of launching an action figure from a location in order to cause the action figure to fly through the air in a predetermined fashion is disclosed. Referring now to the FIGS., an action piece 10 for a toy play set 12 according to one embodiment is illustrated. In one non-limiting embodiment, the action piece is configured to have at least three separate engagement features 14, 16 and 18 each being configured to retain and subsequently release a portion of an action figure.

As shown at least in FIGS. 1-3B and in one non-limiting embodiment, engagement features 14 include a first pair of openings 20 and engagement features 16 include a second pair of openings 22, the second pair of openings having a configuration different than the first pair of openings. Still further, engagement features 18 include a third pair of openings 24 defining a receiving area 26, the third pair of openings having a configuration different than the first pair of openings and the second pair of openings.

As illustrated and in one embodiment, the first pair of openings are separated by a first distance 28 and the second pair of openings are separated by a second distance 30, the second distance being greater than the first distance. Also illustrated in one embodiment is that the third pair of openings are located between the first pair of openings and the second pair of openings.

In various embodiments, the action piece is configured to engage and release a portion of an action figure 32, 34, 36 that is disposed in one of the plurality of engagement features. Although only three action figures are discussed and shown in the attached FIGS. it is, of course, understood that numerous action figures are contemplated to be used with various embodiments of the invention. For example, suitable action figures may be those available from MATTEL sold under the FLEXFORCE. Similarly, the action piece can be configured to have numerous configurations and arrangements wherein the number of engagement features can be increased or decreased as well as changing the configuration of the same.

Figure 3A:
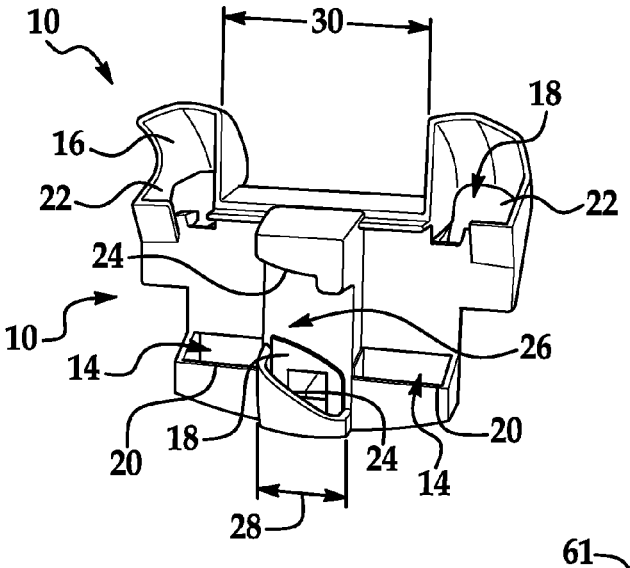
Figure 3B:
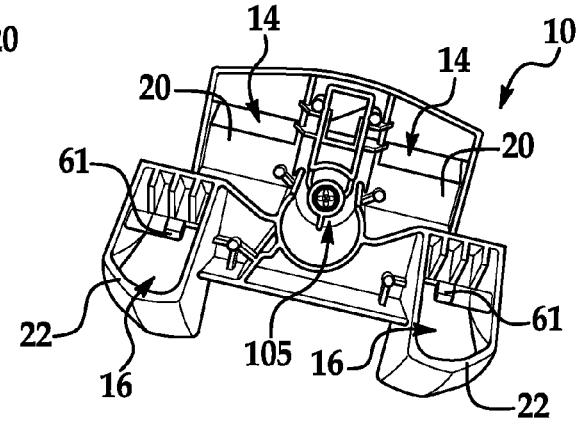
FIG. 3B is a bottom perspective view of the action piece illustrated in FIG. 1.

In one embodiment, each action figure will have a portion spring biased into a first position with respect to the remainder of the action figure. For example and referring now to FIGS. 4 and 5, action figure 32 is shown engaging action piece 10. FIG. 3 illustrates the portion spring biased in the first position. In this embodiment, the portion of the action figure engaging the action piece is a pair of feet 38 configured to engage the first pair of openings. Here the pair of feet are each secured to a lower leg portion or shin portion 40 that is pivotally secured to an upper leg portion or thigh portion 42. The upper leg portion or thigh portion is also pivotally secured to a mid portion or hip portion 44. In order to spring bias the pair of feet to the first position the lower leg portion is spring biased with respect to the thigh portion. In addition, the thigh portion is spring biased with respect to the hip portion.

In order to generate a force to launch the action figure from the action piece after the pair of feet engage the first pair of openings a force is applied to the action figure in the direction of arrow 46 by for example, a user's hand 48 when the pair of feet of the action piece are engaged by the first pair of openings an upper body portion or chest portion 50 moves in the direction of arrow 46 and the upper body portion pivots or rotates with respect to the thigh portions and the thigh portion pivots or rotates with respect to the shin portion and the pair of feet. Accordingly, the action figure is now manipulated to the position illustrated in FIG. 4. In this position, the biasing springs located between the hip and the thigh portions as well as the thigh portions and the shin portions are compressed thereby storing or generating a launching force in a direction opposite to arrow 46.

Figure 4:
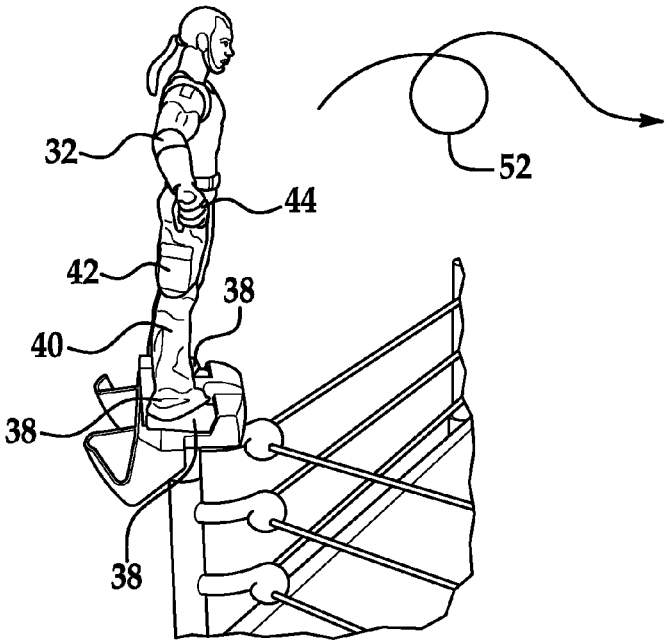
FIG. 4 is a perspective view of an action figure inserted into the action piece.
Figure 5:
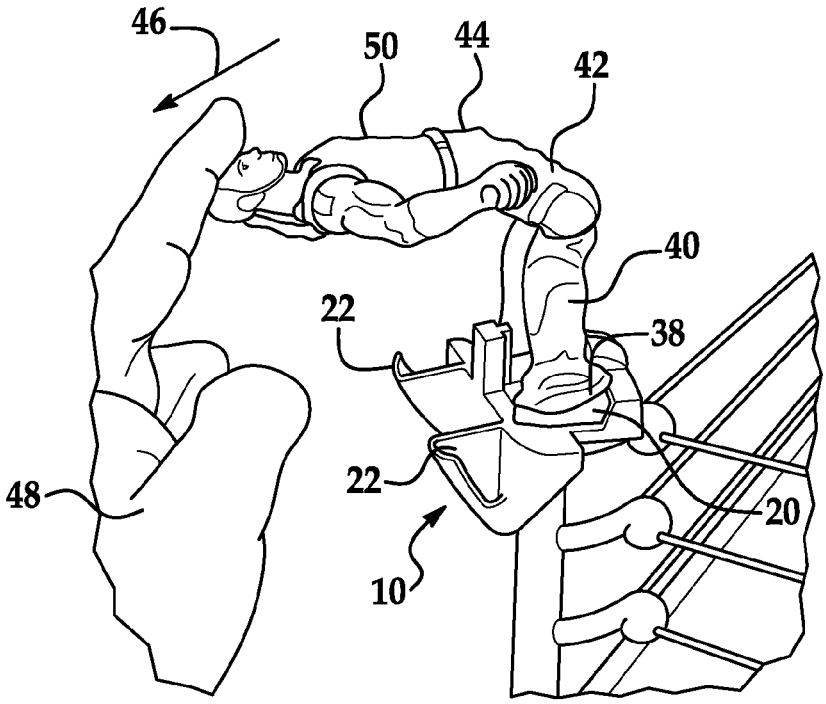
FIG. 5 is a view illustrating the action figure of FIG. 4 moved into a spring biased launching position.

One the user's hand is removed the force in the direction opposite to arrow 46 is released and the upper body portion moves in a direction opposite to arrow 46 and the action figure moves from the position in FIG. 5 to the position in FIG. 4. In so doing, the action figure will launch from the action piece in a rotational manner illustrated by arrow 52.

Figure 6:
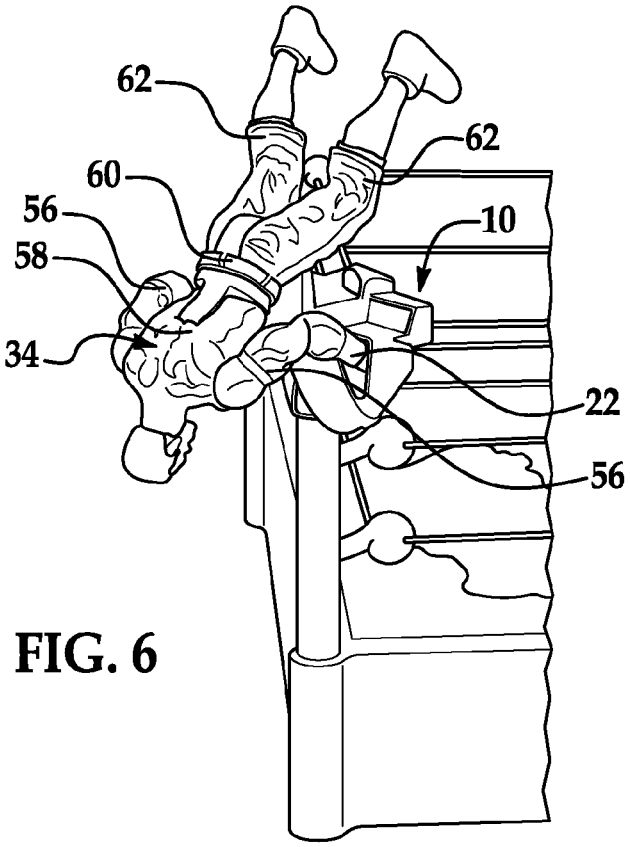
FIG. 6 is a perspective view of another action figure inserted into the action piece.
Figure 7:
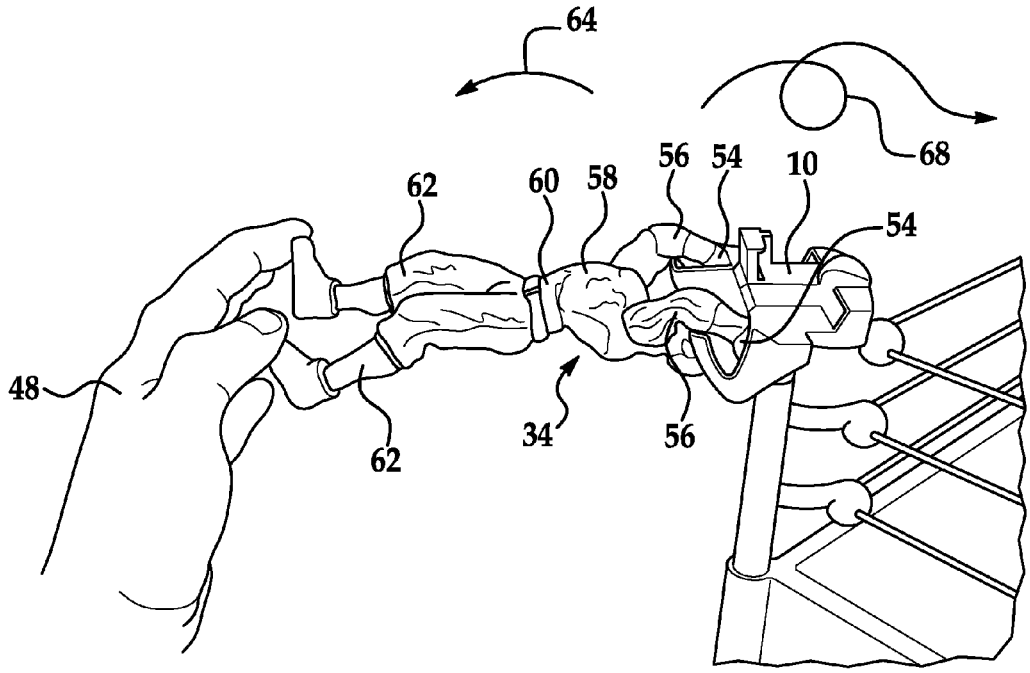
FIG. 7 is a view illustrating the action figure of FIG. 6 moved into a spring biased launching position.

Referring now to FIGS. 6 and 7 action figure 34 is shown engaging action piece 10 wherein the portion of action figure 34 is in the first position. In this embodiment, the portion of the action figure engaging the action piece is a pair of hands 54 configured to engage the second pair of openings. Here the pair of hands are each secured to an arm 56 that is pivotally secured to an upper body portion or chest portion 58 that is pivotally secured to a mid portion or hip portion 60. Referring back now to FIG. 1-3B, the second pair of openings each have a post 61 or feature that extends into the second pair of openings, wherein the pair of posts are configured to be grasped by the pair of hands when they are inserted into the second pair of openings.

In order to spring bias the pair of arms to the first position each of the pair of arms are spring biased with respect to the upper portion. In addition, the upper body portion is spring biased with respect to the hip portion that is secured to a lower body portion or a pair of legs 62.

Thereafter and in order to generate a force to launch the action figure from the action piece a force is applied to the action figure in the direction arrow 64 by for example a user's hand 48 when the pair of hands of the action figure are engaged by the second pair of openings and the lower body portion or pair of legs 62 move in the direction of arrow 64 and the lower body portion pivots or rotates with respect to the upper body portion and the pair of arms. In addition the upper body portion and the pair of arms pivot or rotate with respect to each other. Accordingly, action figure 34 is now manipulated to the position illustrated in FIG. 7. In this position, the biasing springs located between the pair of arms and the upper body portion as well as the upper body portion and the lower body portion are compressed thereby storing or generating a launching force in a direction opposite to arrow 64.

Once the user's hand is removed the force in the direction opposite to arrow 62 is released and the upper body portion moves in a direction opposite to arrow 62 and the action figure moves from the position in FIG. 7 to the position in FIG. 6. In so doing, the action figure will launch from the action piece in a rotational manner illustrated by arrow 68.

Figure 8:
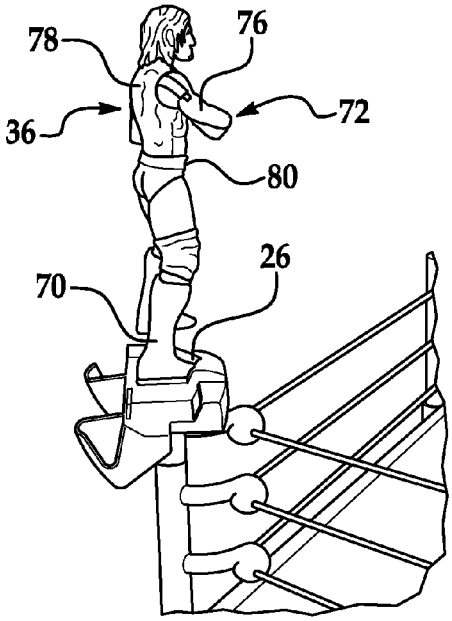
FIG. 8 is a perspective view of still another action figure inserted into the action piece.
Figure 9:
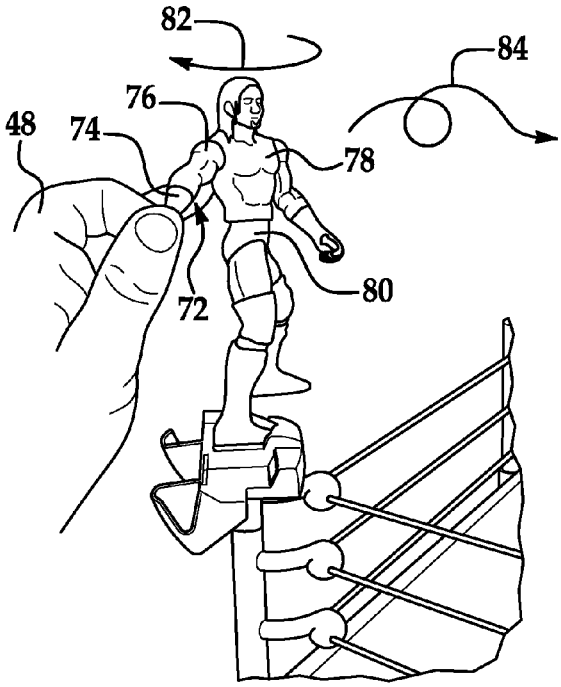
FIG. 9 is a view illustrating the action figure of FIG. 9 moved into a spring biased launching position.
Figure 10A:
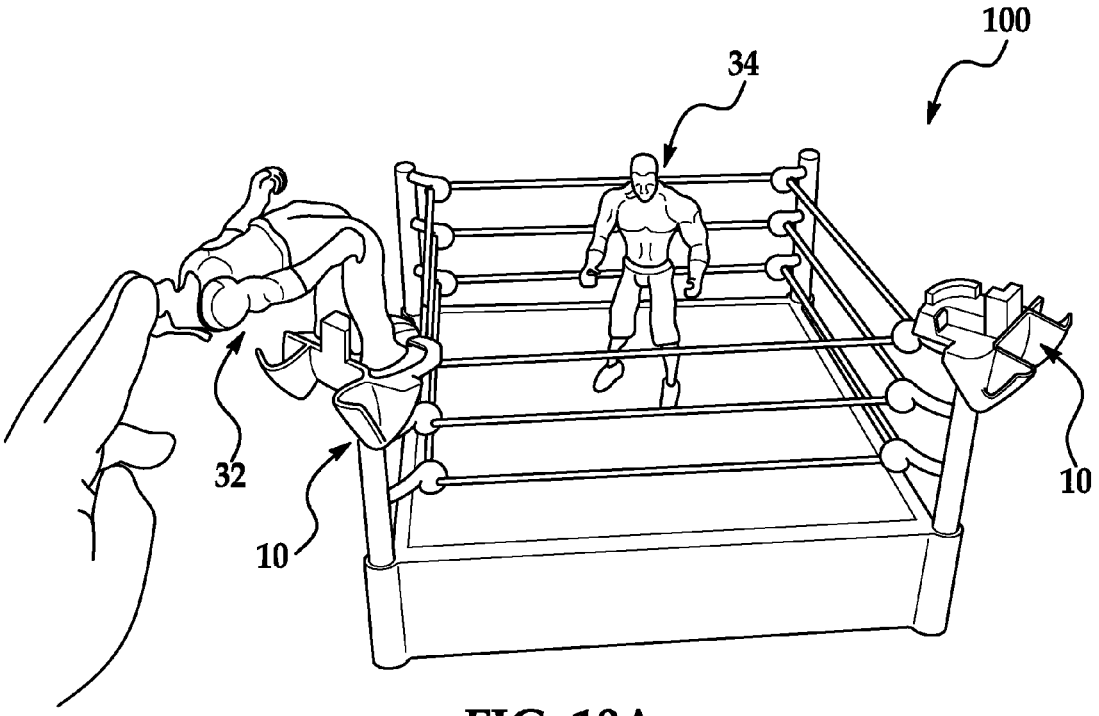
FIGS. 10A-10C are perspective views illustrating action sequences of a play set in one embodiment.
Figure 10B:
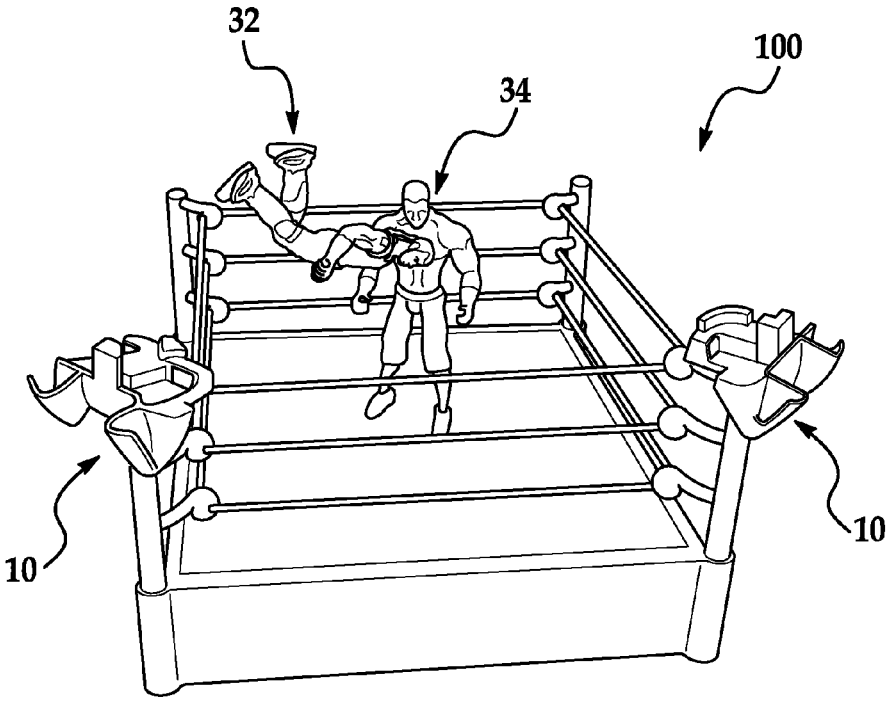
Figure 10C:
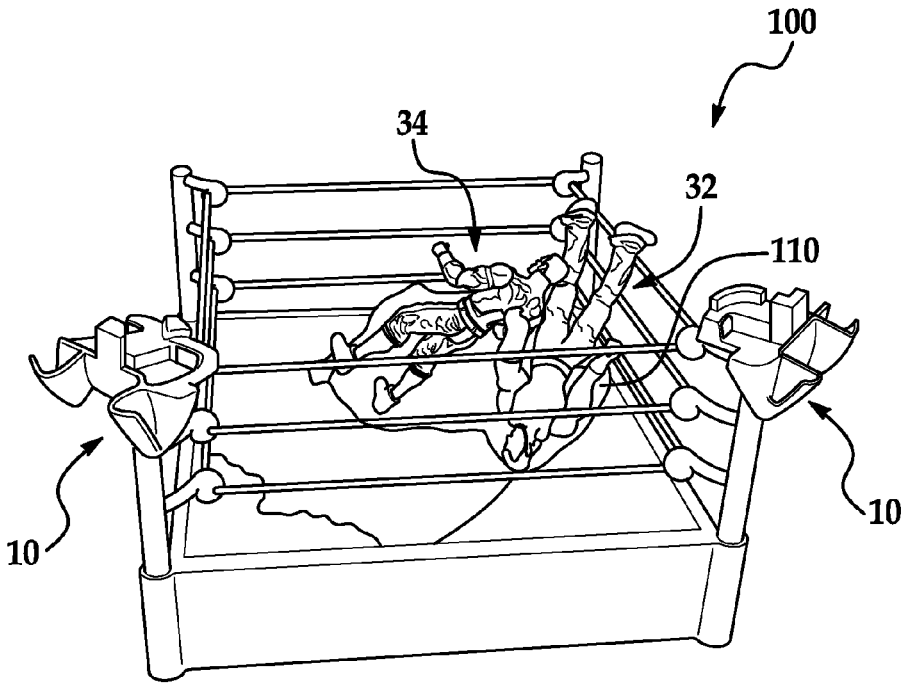
Figure 11A:
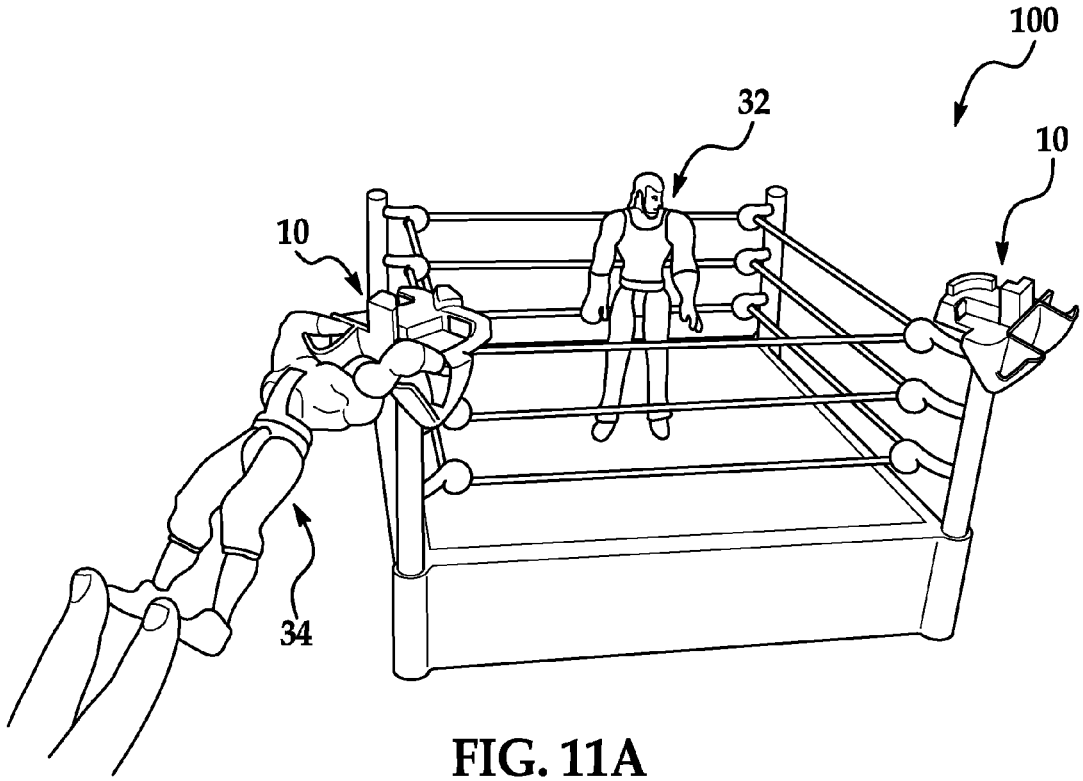
FIGS. 11A-11C are perspective views illustrating action sequences of a play set in another embodiment.
Figure 11B:
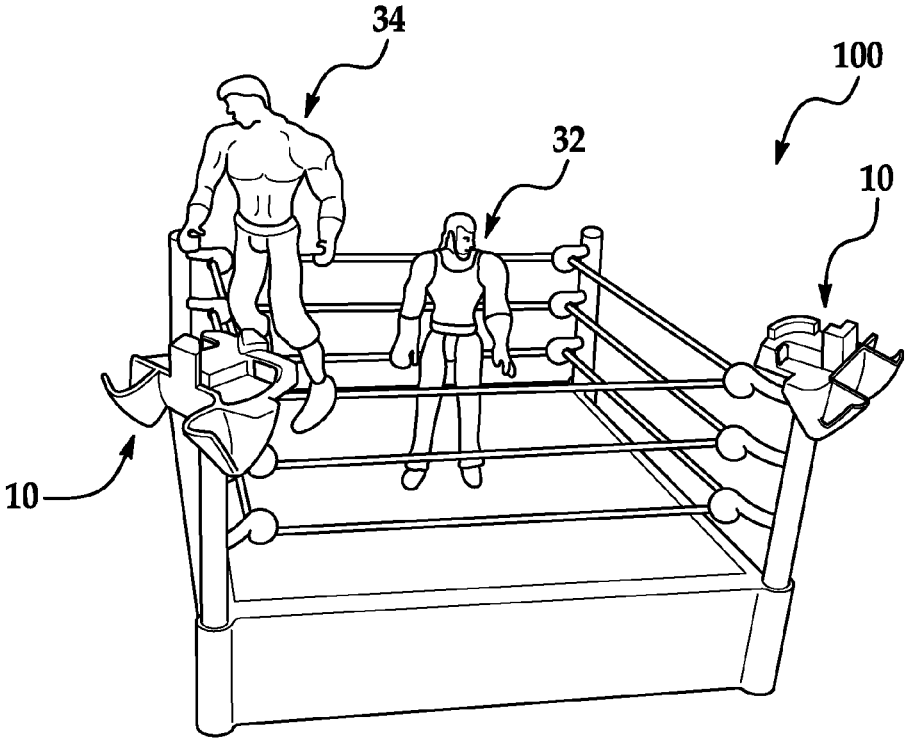
Figure 11C:
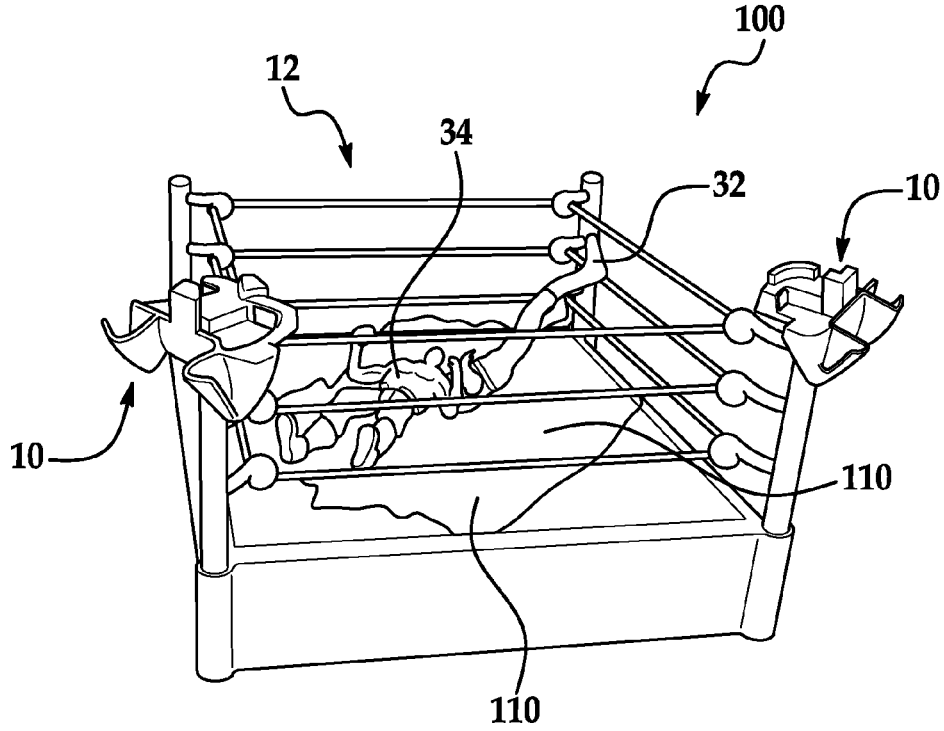

Referring now to FIGS. 8 and 9 action figure 36 is shown engaging action piece 10. In this embodiment, the portion of the action figure engaging the action piece is a single foot 70 configured to be received within the receiving area 26 and engage the third pair of openings 24. Here an arm 72 of the action figure includes a forearm portion 74 pivotally secured to an upper arm portion 76. The upper arm portion 76 is pivotally to an upper body portion or chest 78, which is also pivotally secured to a waist portion 80. Here, the single foot is secured to the waist portion. In order to spring bias the arm and the upper body portion as well as the single foot to the first position the arm (upper and lower arm) are spring biased with respect to the upper body portion and the upper body portion is spring biased with respect to the waist and single foot.

In order to generate a force to launch the action figure from the action piece after the foot is engaged by the third pair of openings a force is applied to the action figure in the direction of arrow 82 by for example, a user's hand 48 wherein the arm (upper and lower portions) and the upper body portion rotates in the direction of arrow 82 (FIG. 8). In this position, the biasing springs located between the hip and the upper body portion as well as the arm portions are compressed thereby storing or generating a launching force in a direction opposite to arrow 82.

One the user's hand is removed the force in the direction opposite to arrow 82 is released and the arm and the upper body portion moves in a direction opposite to arrow 82 and the action figure moves from the position in FIG. 9 to the position in FIG. 8. In so doing, the action figure will launch from the action piece in a rotational manner illustrated by arrow 84.

Referring now to FIGS. 10A-12D, the action figures and the action piece are configured for use with a play set 100 that can include a plurality of action figures and a plurality of action pieces. In one non-limiting embodiment, the play set is configured to resemble a ring structure, having a platform 102 and a perimeter 104 elevated from the platform. In this embodiment, the action piece or pieces are configured to removably engage a portion of the perimeter such that the action piece is located above the platform.

In one embodiment, the play set is configured to resemble a wrestling or boxing ring and each of the action figures are configured to resembled wrestlers wherein the movement of the action figures from the action piece into the ring resembles a "signature move" of the wrestler. Accordingly, the perimeter is defined by a plurality of posts 106 and a plurality of ropes 108 each being secured to the plurality of posts and wherein the action piece is configured to have a feature 105 (See FIG. 3B) that is configured to removably engage at least one of the plurality of posts above the plurality of ropes in at least two different orientations. Feature 105 allows for placement of the action piece on anyone of the plurality of posts and in one embodiment in at least two orientations 180 degrees off set from each other. It being understood that multiple orientations and configurations are within exemplary embodiments of the present invention.

Figure 13A:
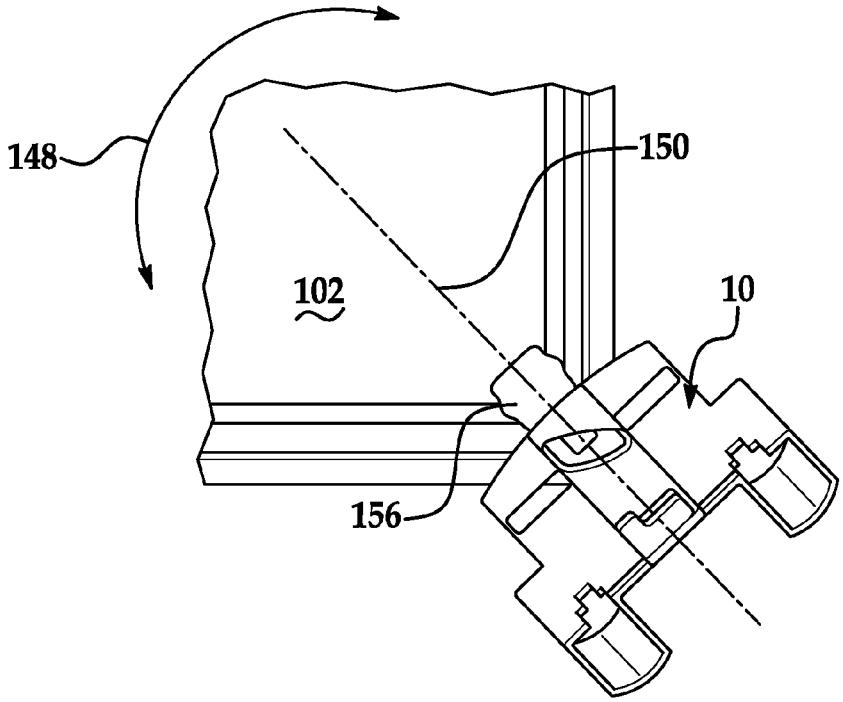
FIGS. 13A, 13B, 14A-14D, 15, and 16A-16C illustrate an action piece in accordance with various embodiments of the present invention.
Figure 13B:
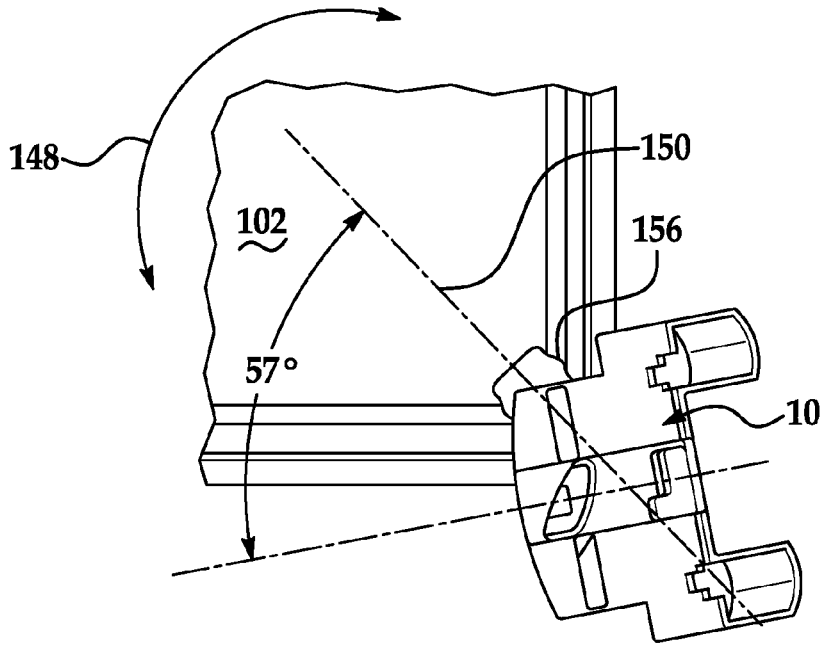
Figure 14B:
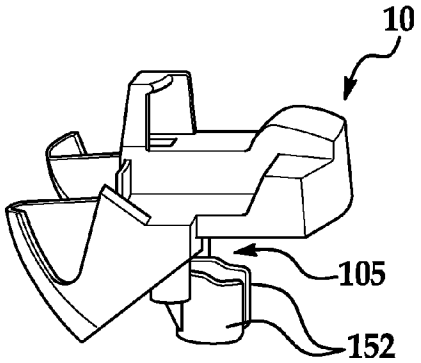
Figure 14D:
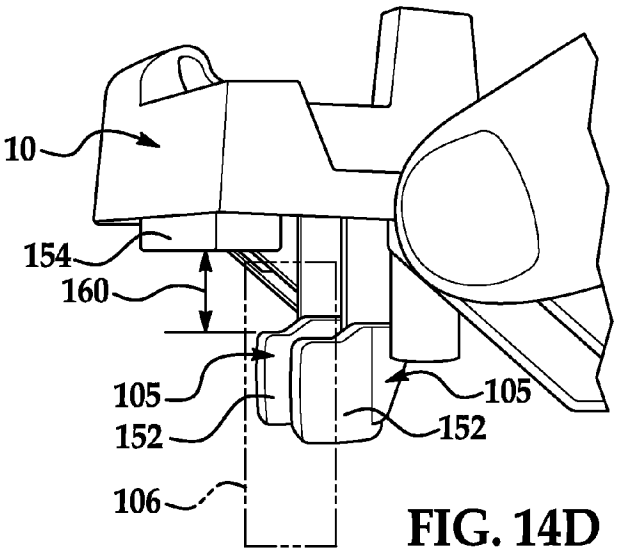
Figure 14A:
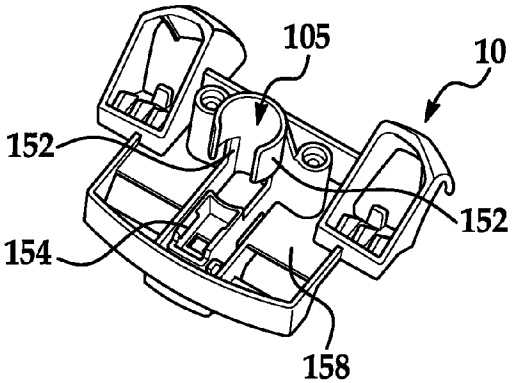
Figure 14C:
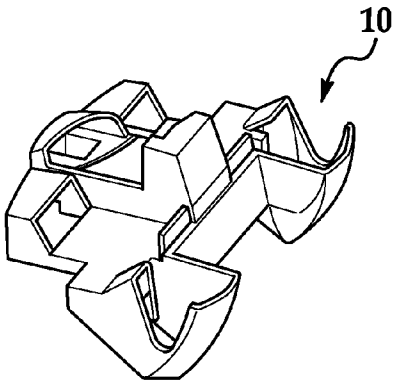

For example and referring to FIGS. 13A and 13B the action piece is illustrated in two different orientations wherein the action piece is moved, swung or rotated from reference line 107. In the illustration the action piece is moved 57 degrees to the left. Of course and as mentioned above, various ranges are contemplated for example, one range of 80 degrees to the left or right in the direction of arrows 148 from the neutral 0 degree reference line 150 for a 160 degree total swing is provided. Other examples include 90 degrees left and right for a total swing of 180 degrees. It is, of course, understood that the aforementioned ranges are merely provided as examples and various embodiments are not specifically limited to the aforementioned ranges.

In one configuration, feature 105 is further defined to have a pair of tab members or arm members 152 each having curved features configured to engage a portion of post 106. In addition, action piece 10 is further configured to have a bottom feature 154 that contacts a top portion of a top gusset 156 that extends from post 106. By contacting the top gusset 156 with feature 154 the action piece is capable of being able to engage at least one of the plurality of posts above the plurality of ropes in at least two different orientations such that the action figure may be launched therefrom using one of the "signature moves".

As illustrated, the pair of tab members or arm members 152 are separated from a bottom surface 158 of the action piece 10 or the feature 105 such that a gap 160 is provided between feature 154 and tabs or arm members 152 such that top gusset 156 can pass therethrough as the action piece is moved between the at least two different orientations.

Figure 16A:
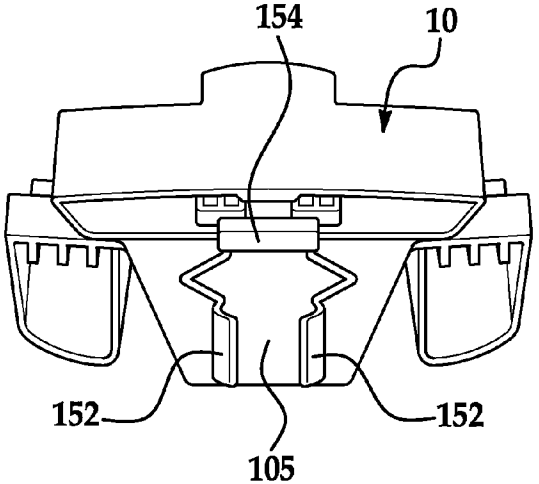
Figure 16C:
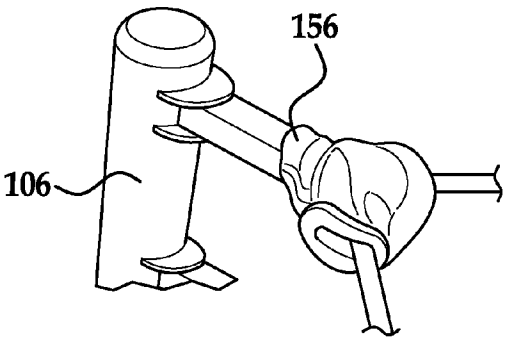
Figure 15:
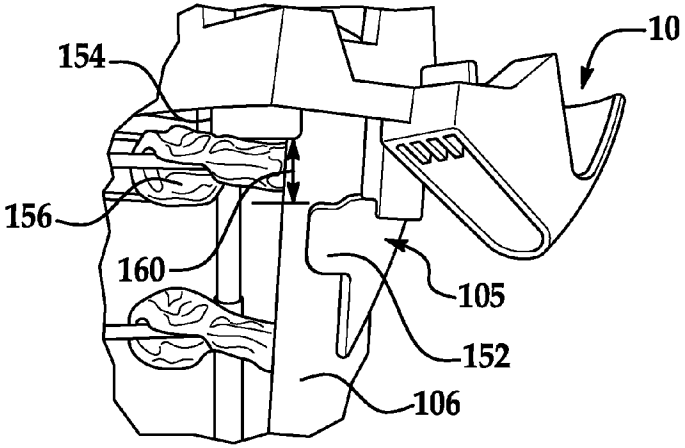
Figure 16B:
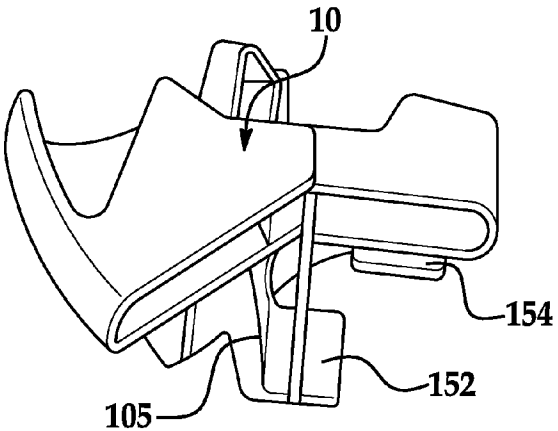

As mentioned above, numerous configurations of feature 105 are contemplated to allow for at least two different orientations of the action piece. For example, in FIGS. 16A-16C an alternative configuration of feature 105 is provided for use with a post 106 and top gusset configuration illustrated in FIG. 16C. Still other configurations contemplate a post that is merely rotationally received with feature 105.

In this configuration, the action figures or wrestlers are capable of performing their signature moves from atop the posts of the ring. Although, the FIGS. illustrate the action figures flying into the ring it is also understood that the figures may launch from the action piece away from the ring or the action piece may be secured to any other suitable structure wherein the action figure may launch therefrom.

Figure 12A:
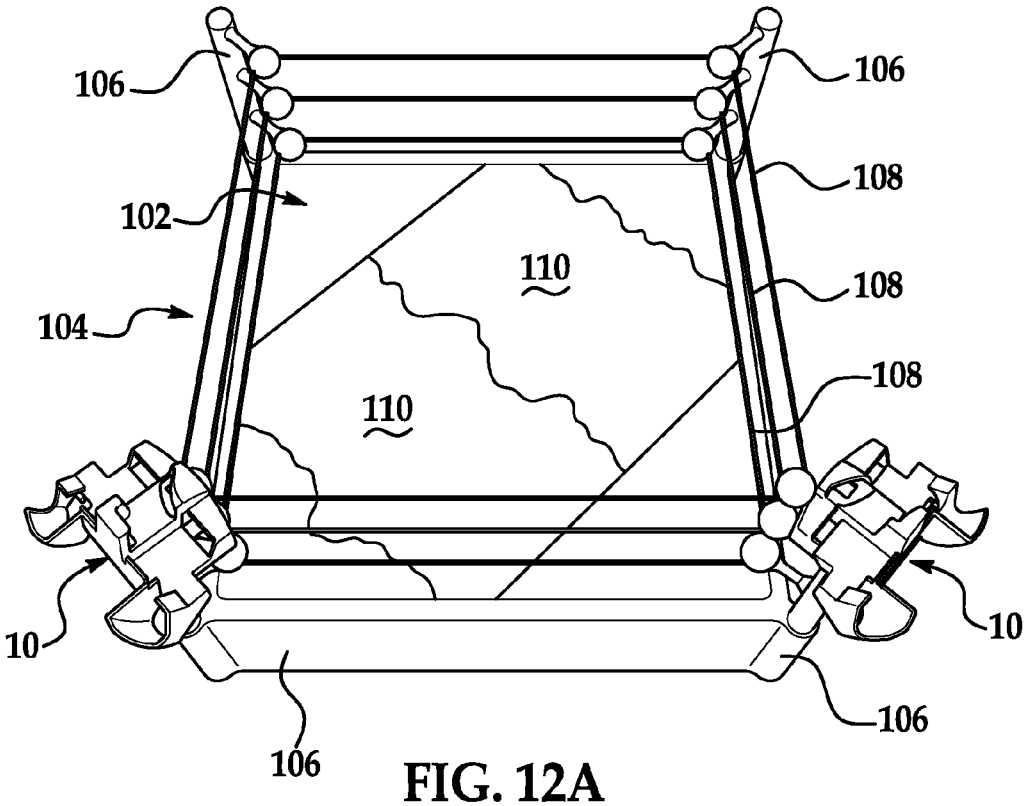
FIG. 12A is a top perspective view of the play set.
Figure 12B:
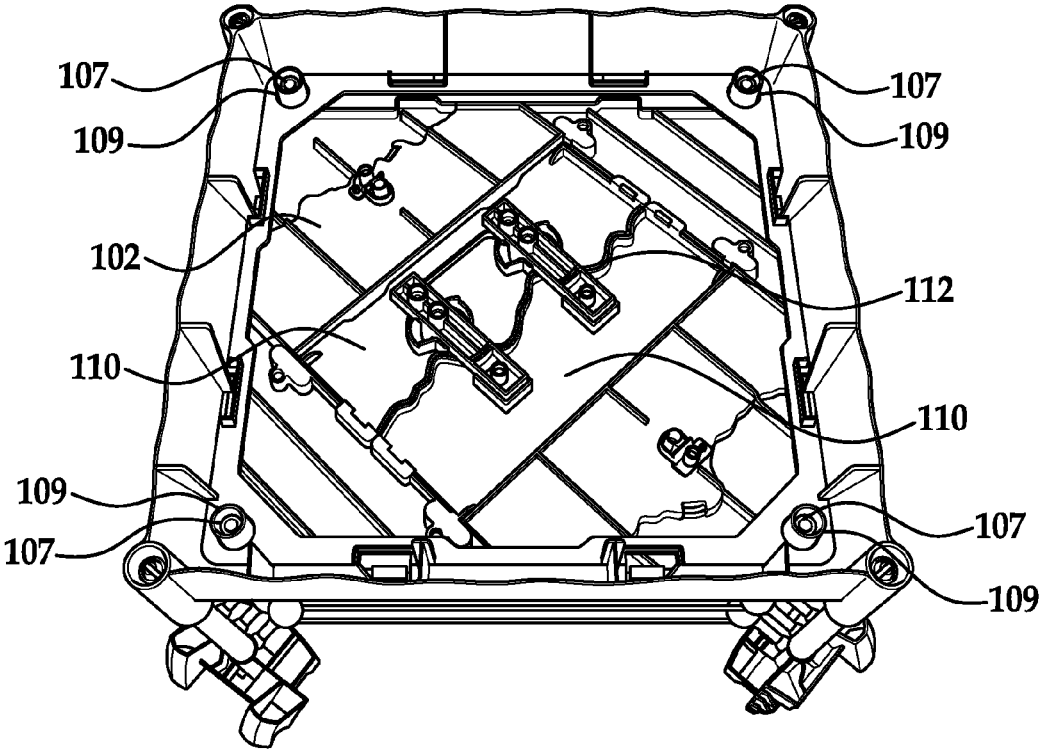
FIGS. 12B and 12C are bottom perspective views of the play set.
Figure 12C:
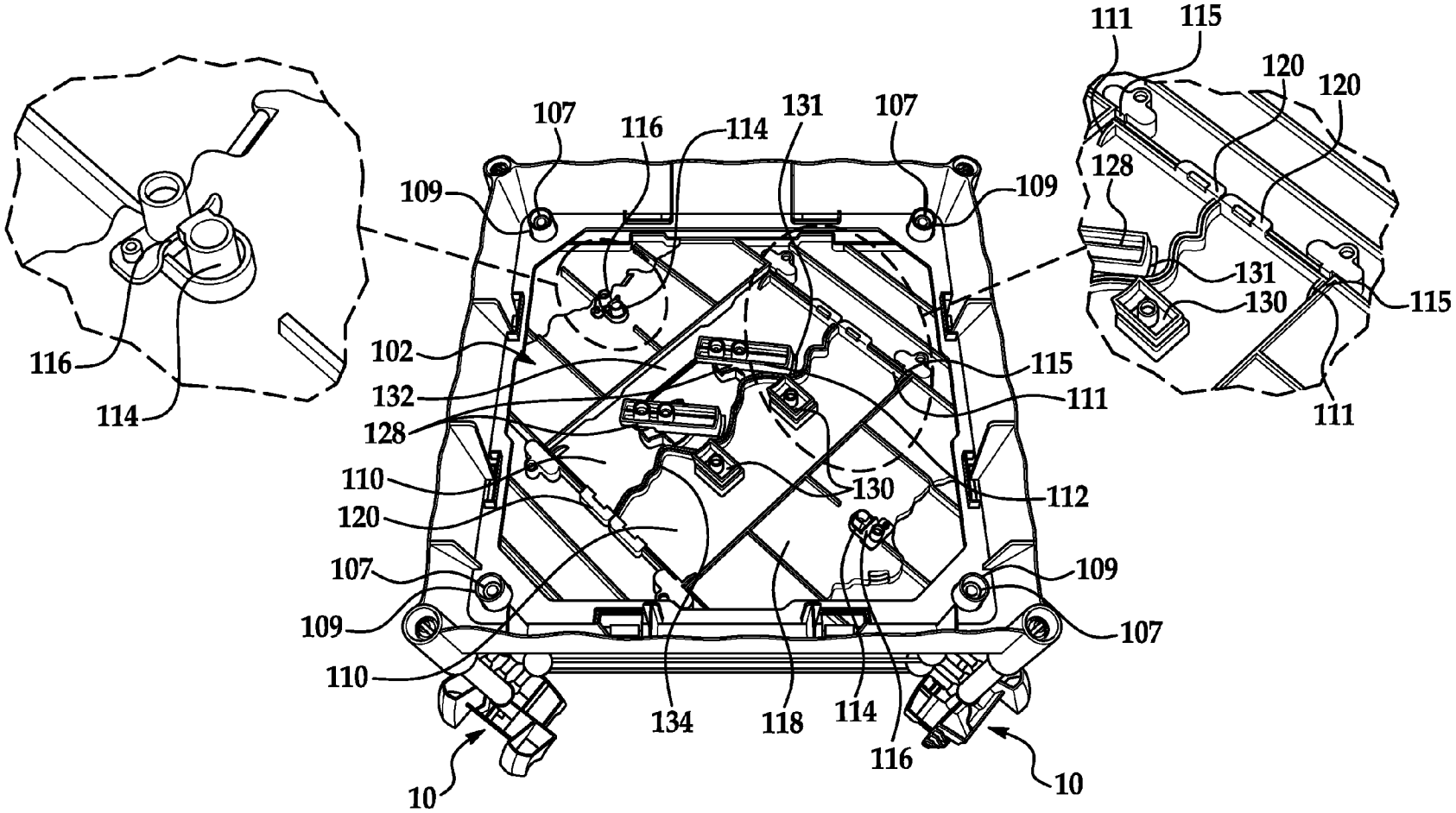
Figure 12D:
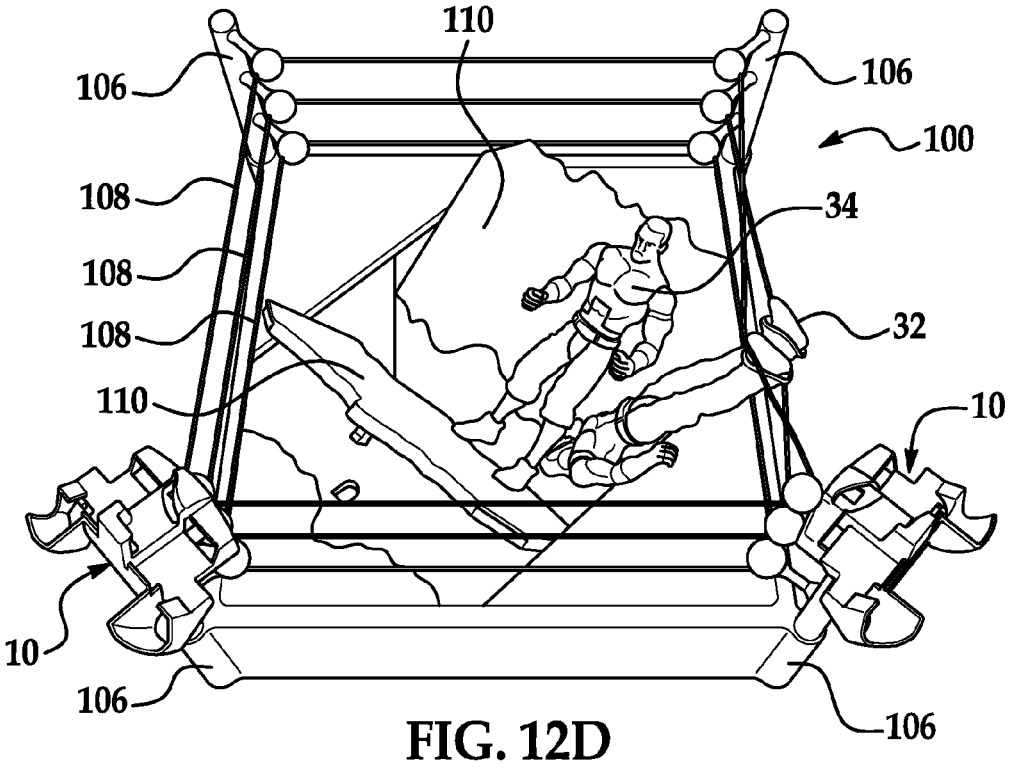
FIG. 12D is another top perspective view of the play set.

In one alternative embodiment, the platform is spring biased by providing a plurality of spring members on each corner of the platform. For example, a spring may be located about each one of a plurality of posts 107 slidably received within a plurality of corresponding openings 109 to provide a shock adsorbing effect to the platform to resemble a realistic ring. The springs being configured to not pass though openings 109 while engaging a portion of post 107 to provide an upward biasing force to the platform. In still another exemplary embodiment and referring now to FIGS. 12B and 12C, the platform comprises a pair of interlocking members 110 pivotally secured to the platform for movement between an engaged position (FIGS. 12A-12C) and a released position (FIG. 12D). In one non-limiting embodiment, the pair of interlocking members are pivotally secured to other portions of the ring and/or play set by pins 111 rotatably received within features or openings 115 of the ring. Although a pair of interlocking members are illustrated it is, of course, understood that a single member or more than two members may be pivotally or movably secured to non-moving portions of the ring or play set and other equivalent means for pivotally securing them to the play set are considered to be within the scope of various embodiments of the invention.

In this embodiment, a release hasp or lever 112 (FIGS. 12B and 12C) is movably secured to one of the interlocking members for movement between a locked position (FIG. 12B) wherein the interlocking members remain secured to each other or an unlocked position (FIG. 12C) wherein the interlocking members can move from the engaged position to the released position (FIG. 12D).

In this embodiment and after the interlocking members are moved to the unlocked position, the engaged position of the pair of interlocking members is maintained by a feature or features 114 of each member that releasably engages another feature 116 of non-pivoting portions 118 of the platform such that frictional engagement of feature 114 with feature 116 will retain the interlocking members secured to a non-moving portion or portions 118 of the platform until a force overcoming the frictional engagement of features 114 and 116 is applied to the pair of interlocking members. In addition, tab members 120 will retain the interlocking members from pivoting past non-moving portions of the platform. During play and when hasp or lever 112 is in the unlocked position and an action figure is launched from the action piece and collides with another action figure and/or the platform in the ring, the resulting force upon the upper surface of the platform will cause features 114 to become disengaged from features 116 and the interlocking member or members of the ring will move to the released position illustrated at least in FIG. 12D.

As illustrated, the release hasp or lever 112 comprises a pair of spaced members 128 each being pivotally secured to one of the pair of interlocking members for movement between the locked position and the unlocked position. In the locked position each of the pair of spaced members 128 engages a complimentary fixed feature 130 located on the other one of the pair of interlocking members such that contact between the pair of spaced members 128 and the fixed features 130 prevents the pair of interlocking members from pivoting or moving to the released position.

In one embodiment, each of the pair of spaced members 128 comprises a tab feature 131 configured to engage an edge or shoulder portion of features 130 while they are in the locked position. In addition, a connecting member 132 is pivotally secured to each of the pair of spaced members 128 to move or pivot both of the pair of engagement members when one of the pair of spaced members is moved or pivoted. Furthermore, the pair of spaced members allows two discrete and separate points of securement along the line of separation 134 of the pair of interlocking members. This will assist in providing a more uniform and sturdy method of securement along the line of separation such that the pair of pair of interlocking members cannot be twisted out of a flush arrangement with respect to each other when the hasp or lever 112 is in the locked position. In addition and in one non-limiting exemplary embodiment, the distal ends of the pair of spaced members 128 are curved to match a complimentary curved portion of the feature such that the pair of spaced members may be pivoted, moved or rotated into and out of the locked and unlocked position as well as provide a robust securement therebetween in addition to providing a stop or detent indicating the pair of spaced members are in a locked position.

Figure 12E:
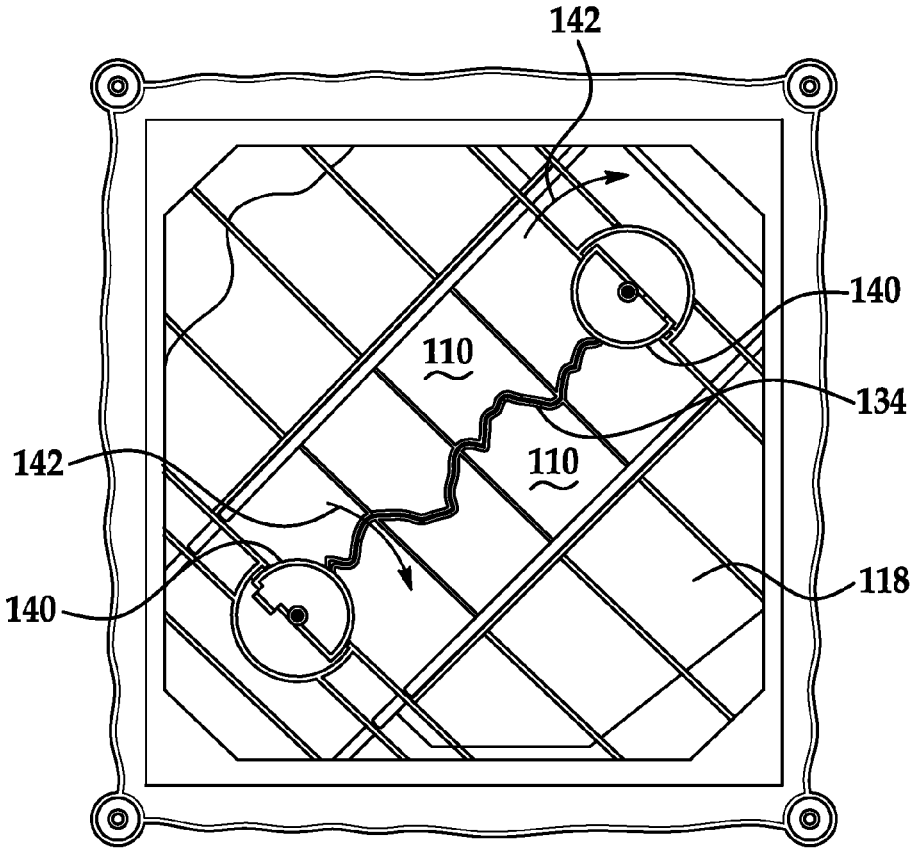
FIG. 12E is a bottom view of a play set constructed in accordance with an alternative exemplary embodiment.

In an alternative exemplary embodiment and referring now to FIG. 12E, the locking mechanism comprises a pair of rotating members 140 each being rotatably secured to a non-moving portion 118 of the platform proximate to peripheral edge portions of both of the pair of interlocking members such that when the pair of rotating members 140 are in the locked position (illustrated in FIG. 12E) portions of the pair of rotating members 140 are positioned to block portions of both of the pair of interlocking members such that they cannot be pivoted into the released position. In order to move the pair of rotating members into the unlocked position each of the members is rotated in the direction of arrows 142 such that no portion of the pair of rotating members is positioned to block movement of the pair of interlocking members and they can now be moved to the released position. Similar to the previous embodiment, a feature may be employed to retain the pair of interlocking members in the engaged position until a sufficient force is applied to disengage the features and allow the pair of interlocking members to move to the released position. In order to return the ring of the play set back to a platform that does not collapse the user simply moves the pair of rotating members in a direction opposite to arrows 142 when the pair of interlocking members are in the engaged position until portions of the pair of rotating members 140 are positioned to block portions of both of the pair of interlocking members such that they cannot be pivoted into the released position.

Although specific embodiments of the locking mechanism and movably interlocking members are illustrated numerous equivalent structures and configurations are considered to be within the scope of exemplary embodiments of the present invention.

Accordingly, a method of launching an action figure from a play set in order to cause the action figure to fly through the air in a predetermined fashion is also provided. As described herein there are multiple action point pieces, which removably slide onto the tops of any ring post and serve as launching platforms for the action figures. Each type of action figure fits into the action pieces' unique foot/handholds and by utilizing the flexible spring biased feature of the action figure the figure can be launched from the action piece. The action pieces also allow the action figure to stand up high to resemble a threatening position on the top rope. Also, the platform or mat is equipped with a locking knob or levers 112 and when lever 112 are unlocked launched figures hitting the platform hard enough will cause the platform or mat break or move to the released position with jagged edges, sending the action figures crashing through the ring.

While the present invention has been described in terms of specific embodiments, it should be appreciated that the spirit and scope of the invention is not limited to those embodiments. The features, functions, elements and/or properties, and/or combination and combinations of features, functions, elements and/or properties of the present invention may be claimed in this or a related application. All subject matter which comes within the meaning and range of equivalency of the claims is to be embraced within the scope of such claims.

What is claimed is:

1. An action piece for a toy play set, the action piece being configured to have at least three separate engagement features each configured to simultaneously retain and subsequently release separate portions of an action figure, wherein a first one of the at least three separate engagement features includes a first pair of openings; and a second one of the at least three separate engagement features includes a second pair of openings, the second pair of openings having a configuration different than the first pair of openings; and a third one of the at least three separate engagement features includes a third pair of openings defining a receiving area, the third pair of openings having a configuration different than the first pair of openings and the second pair of openings; and the action piece being further removably engaged to a portion of the toy play set.

2. The action piece as in claim 1, wherein the first pair of openings are separated by a first distance and the second pair of openings are separated by a second distance, the second distance being greater than the first distance.

3. The action piece as in claim 2, wherein the third pair of openings are located between the first pair of openings and the second pair of openings.

4. The action piece as in claim 1, wherein the separate portions of the action figure are a pair of feet configured to engage the first pair of openings and wherein the second pair of openings are configured to engage a pair of hands of another action figure; and wherein the receiving area is configured to engage a foot of one other action figure.

5. The action piece as in claim 4, wherein a pair of posts extend into the second pair of openings the pair of posts being configured to be grasped by the pair of hands.

6. A play set, comprising:

a ring structure, having a platform and a perimeter elevated from the platform; and at least one action figure, having a portion spring biased into a first position; and an action piece for securement to a portion of the perimeter such that the action piece is located above the platform, the action piece being configured to have at least one engagement feature configured to retain and subsequently release the portion of the action figure, wherein the action piece is configured to have at least three separate engagement features and the play set comprises at least three action figures wherein each of the at least three separate engagement features is configured to retain and subsequently release a portion of one of the at least three action figures.

7. The play set as in claim 6, wherein movement of the portion from the first position after the portion is retained by the engagement feature of the action piece creates a biasing force that will launch the action figure from the action piece when the biasing force is released.

8. The play set as in claim 6, wherein the perimeter is defined by a plurality of posts and a plurality of ropes each being secured to the plurality of posts and wherein the action piece is configured to removably engage at least one of the plurality of posts above the plurality of ropes.

9. The play set as in claim 8, wherein the action piece has a feature that is configured to removably engage at least one of the plurality of posts above the plurality of ropes in at least two different orientations.

10. The play set as in claim 6, wherein the portion is a first distal body portion pivotally secured to a second body portion, the second body portion being pivotally secured to another body portion, wherein the first distal body portion is spring biased with respect to the second body portion and the second body portion is spring biased with respect to the another body portion.

11. The play set as in claim 10, wherein the first distal body portion is selected from the group comprising: a pair of feet; a pair of arms; and an arm.

12. A play set, comprising:

a ring structure, having a platform and a perimeter elevated from the platform; and at least one action figure, having a portion spring biased into a first position; and an action piece for securement to a portion of the perimeter such that the action piece is located above the platform, the action piece being configured to have at least one engagement feature configured to retain and subsequently release the portion of the action figure, wherein a first one of the at least three separate engagement features includes a first pair of openings; and a second one of the at least three separate engagement features includes a second pair of openings, the second pair of openings having a configuration different than the first pair of openings; and a third one of the at least three separate engagement features includes a third pair of openings defining a receiving area, the third pair of openings having a configuration different than the first pair of openings and the second pair of openings.

13. The play set as in claim 12, wherein the first pair of openings are separated by a first distance and the second pair of openings are separated by a second distance, the second distance being greater than the first distance.

14. The play set as in claim 13, wherein the third pair of openings are located between the first pair of openings and the second pair of openings.

15. The play set as in claim 12, wherein the portion of the action figure is a pair of feet configured to engage the first pair of openings and wherein the second pair of openings are configured to engage a pair of hands of another action figure; and wherein the receiving area is configured to engage a foot of one other action figure.

16. The play set as in claim 15, wherein a pair of posts extend into the second pair of openings the pair of posts being configured to be grasped by the pair of hands.

* * * * *